United States Patent [19]

Yoshizawa

[11] Patent Number: 4,609,226

[45] Date of Patent: Sep. 2, 1986

[54] VEHICLE SEAT

[75] Inventor: Toshio Yoshizawa, Akishimashi, Japan

[73] Assignee: Tachikawa Spring Co., Ltd., Tokyo, Japan

[21] Appl. No.: 640,522

[22] Filed: Aug. 14, 1984

[51] Int. Cl.[4] ..... A47C 7/02

[52] U.S. Cl. ..... 297/452; 297/DIG. 2; 297/458

[58] Field of Search ..... 297/452, DIG. 1, 458, 297/459

[56] References Cited

U.S. PATENT DOCUMENTS

| | | | |
|---|---|---|---|
| 2,703,603 | 3/1955 | Endicott | 297/452 X |
| 3,401,217 | 9/1968 | Burwell | 297/458 X |
| 3,537,752 | 11/1970 | Kushnarov et al. | 297/458 X |
| 3,727,980 | 4/1973 | Tischler | 297/458 X |
| 4,379,352 | 4/1983 | Häuslein et al. | 297/452 X |

FOREIGN PATENT DOCUMENTS

| | | | |
|---|---|---|---|
| 2308032 | 9/1973 | Fed. Rep. of Germany | 297/459 |
| 2357491 | 5/1974 | Fed. Rep. of Germany | 297/459 |
| 3231263 | 2/1984 | Fed. Rep. of Germany | 297/DIG. 1 |
| 1018951 | 2/1966 | United Kingdom | 297/458 |

*Primary Examiner*—William E. Lyddane
*Assistant Examiner*—José V. Chen
*Attorney, Agent, or Firm*—Hoffmann, Dilworth, Barrese & Baron

[57] ABSTRACT

A seat for use in a vehicle such as an automobile is disclosed which comprises a cushion member formed of foam material, a top member for covering the cushion member and a plurality of hanger members. In this seat, the top surface of the top member and the upper portion of the cushion member are respectively divided into a central portion and side portions independently of each other. A partition cloth is provided between the central and side portions of the top member and is then inserted within a cut groove separating the central and side portions of the cushion member from each other. After then, the hanger member is used to pull the inserted partition cloth and thus the top surface of the top member into their respective desired positions. With this structure, when an occupant is seated on the central portion of the seat, it is ensured that such a load applied to the central portion of the seat by the occupant will not have a deterimental effect on the peripheral or side portions of the seat.

1 Claim, 9 Drawing Figures

VEHICLE SEAT

BACKGROUND OF THE INVENTION

1. Field of the Invention

The present invention relates to a seat for use in a vehicle such as an automobile and, more particularly, to an improved vehicle seat which comprises a cushion member formed of a foam material, a top member covering the cushion member, and a hang-in member for hanging the upper surface of the top member into the bottom portion of the cushion or hanger member.

2. Description of the Prior Art

FIG. 1 illustrates a conventional seat (A″) of this type. In this figure, reference character (a″) designates a cushion member formed of foam material such as urethane foam. The cushion member (a″) comprises a central portion (10), and two raised side portions (11) (11) located around the central portion (10) and foamed integrally with the central portion (10). There are formed through-bores for insertion of hang-in members (2″) extending vertically along boundary lines between the central portion (10) and side portions (11) (11) at a predetermined interval. Character (b″) represents a top member for covering the cushion or hanger member (a″). Onto the rear surface side of the top member (b″) are sewn the ends of the hanger members (2″)(2″) such as hanging strings to be inserted through the through-bores of the cushion member (a″).

When an occupant is seated on this seat (A″), the seat (A″) is caused to deform in the manner as shown in FIG. 1. In other words, if a load is applied to the central portion (10) of the cushion member (a″), then the central portion (10) is bent downwardly, which downward bending in turn causes the side portions (11) (11) of the cushion member (a″) to rise up from their original positions as shown by two-dot chained lines to such positions as shown by solid lines.

Accordingly, as shown in FIG. 1, since the side portions, when raised up, are brought into contact with the buttocks of the occupant, such conventional seat gives the occupant an uncomfortable feeling. Also, because the side portions of the cushion member are displaced whenever the occupant is seated, such side portions tend to get weak-kneed or will not be able to retain their shapes. As a result of this, there are produced wrinkles in the top member which covers such weakened cushion member side portions, which wrinkles deteriorate the aesthetic appearance of the seat.

To avoid the drawbacks mentioned above, there is proposed a seat in which the central portion and side portions of a cushion member are respectively formed of separate foam materials, that is, in which the side portions of the cushion member are formed of harder urethane foam over the central portion thereof. The newly proposed seat, however, is disadvantageous in that it can not be easily manufactured by using a mold.

SUMMARY OF THE INVENTION

The present invention aims at eliminating the drawbacks encountered in the above-mentioned prior art vehicle seats.

Accordingly, it is a primary object of the invention to provide a new and improved vehicle seat eliminates the rise-up or stand-up movements of its side portions when an occupant is seated on the seat.

In brief, to accomplish the above object, according to the invention, there are formed cut grooves in the peripheries of a central portion of a cushion member which extend on and from the upper surface of the cushion member inwardly of the cushion member, so that these cut grooves divide the upper portion of the cushion member into a central portion and two side portions. On the other hand, a top member to cover this cushion member is divided into a portion for covering the central portion of the cushion member and portions for covering the side portions of the same, and there is provided a partition cloth between these divided central and side portions, which partition cloth is inserted into the cushion member and is secured to a hanger member.

Accordingly, according to the invention, since the cushion member and the top member are respectively formed to comprise one central portion and two side portions which are independent from each other, when an occupant is seated on the seat of the invention, the seat will not be deflected so greatly as the above-mentioned conventional seats. Also, because the side portions of the cushion member are delected, the cushion member will not give way or get weak-kneed but can maintain its cushioning property, so that no wrinkles will not be produced in the top member covering the side portions of the cushion member.

The above and other objects, features and advantages of the invention will be more apparent to those skilled in the art from the following detailed description taken in connection with accompanying drawings, throughout which like reference numerals or characters represent like components or corresponding components.

DETAILED DESCRIPTION OF PREFERRED EMBODIMENTS OF THE INVENTION

Figure 1:
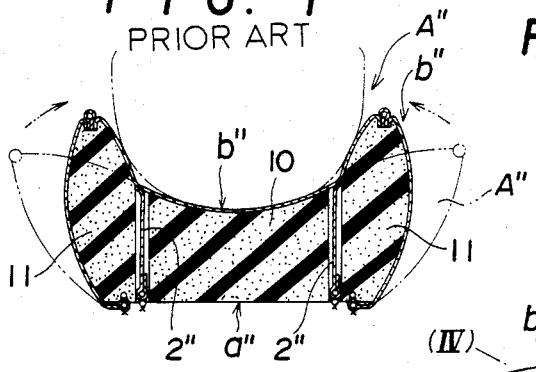
FIG. 1 PRIOR ART
FIG. 1 is a longitudinal section view of a conventional vehicle seat.
Figure 2:
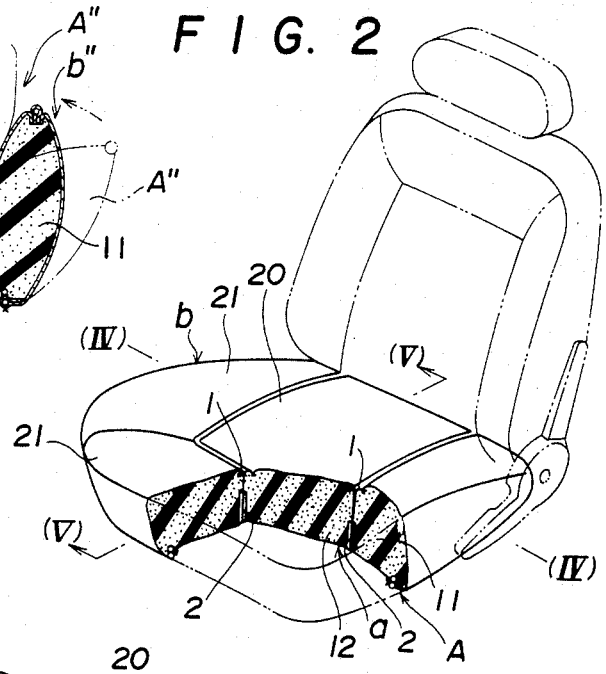
FIG. 2 is a partially cutaway perspective view of a first embodiment of the invention.
Figure 3:
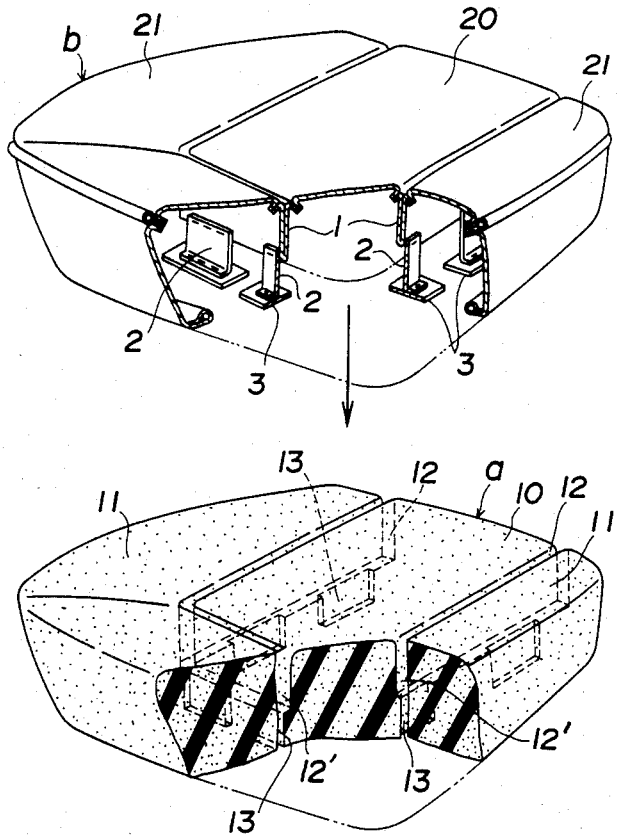
FIG. 3 is a partially cutaway, exploded perspective view of the first embodiment.

FIGS. 2–6 illustrate a single seat (A)—a first embodiment—constructed in accordance with the invention. In the drawings, reference character (a) designates a cushion member (a molded product) formed of foam material having a predetermined cushioning property, such as urethane foam, and (b) represents a top member which is connected and fixed at its ends by hog rings (5) or the like to lower frame edges (4) embedded in the bottom portion of the cushion member (a) so as to cover up the entire cushion member (a).

After covered up by the top member (b), the cushion member (a) is placed in and fixed to a saucer-like hard frame, which is not shown in the drawings.

The above-mentioned cushion member (a) is formed on its top surface with cut grooves (12') extending along boundary lines between a flat central portion (10) of the cushion member (a) located centrally thereof and protruded side portions (11) located on the peripheries of the cushion member (a). The cushion member (a) is also formed with a plurality of through-bores (13) for insertion of hanger members (2). These bores (13) are spaced at predetermined intervals from each other and extends from the bottom of the cut groove (12') toward the bottom of the cushion member (a).

On the other hand, the top member (b) is divided to form a central portion or body portion (20) and two side portions or frame portions (21) which respectively correspond to the central portion (10) and side portions (11) formed on the top surface side of the cushion member (a). And, a plurality of partition cloths (1) are sewn up to division edges formed between the body portion (20) and the frame portions (21) of the top member (b).

Each of the partition cloths (1) is a long strip formed of the same material as that of the top member (b). While one of side edges of the partition cloth (1) is sewn up longitudinally to the division edge of the body portion (20) of the top member (b) and the other is sewn up longitudinally to the connection edge of the frame portion (21), the partition cloth (1) is folded double with its both ends being faced upwardly and is fitted into the cut groove (12') of the cushion member (a), onto which folded portion are mounted the tip ends of a plurality of hanger members (2) at proper intervals.

Figure 4:
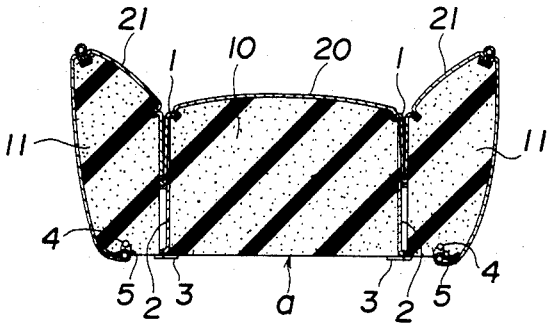
FIG. 4 is an end view taken along line (IV)—(IV) in FIG. 2.
Figure 5:
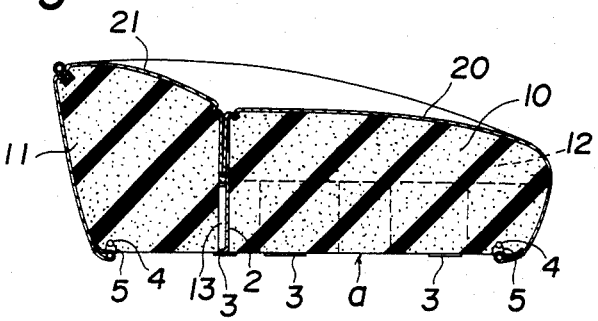
FIG. 5 is a longitudinal section view taken along line (V)—(V) in FIG. 2.
Figure 6:
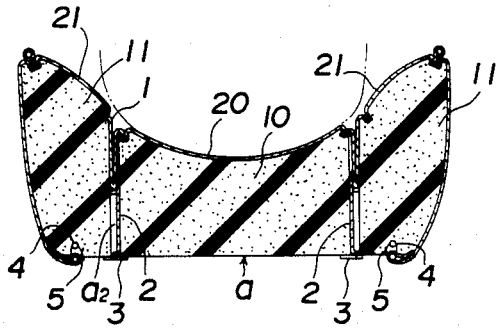
FIG. 6 is a longitudinal section view of the first embodiment, illustrating the state of the same when an occupant is seated thereon.

Accordingly, if the hanger member (2) is pulled downwardly and a securing plate (3) fixed to the lower end of the hanger member (2) is secured crosswise to the bottom face of the cushion member (a), then the top surface of the top member (b) is drawn in or hung in while it remains in close contact with the upper or top surface of the cushion member (a), (FIGS. 4 and 5). Also, since the body portion (20) and frame portions (21) of the top member (b) and the upper portion of the cushion member (a) are formed substantially independent from one another, even when the occupant is seated on the body portion (20), the frame portions of the seat (A) will not be raised up as in the prior art, FIG. 6).

Figure 7:
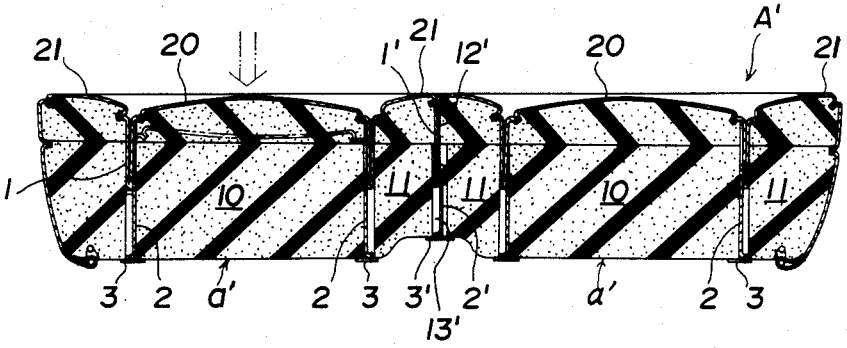
FIG. 7 is a longitudinal section view of a second embodiment of the invention.
Figure 8:
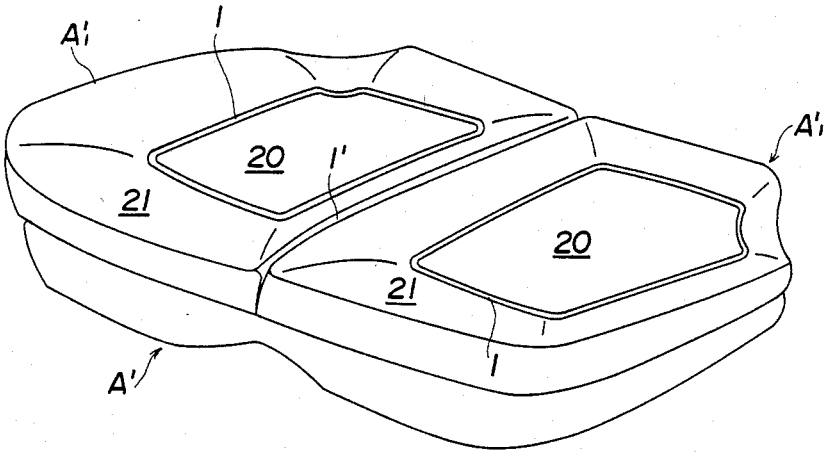
FIG. 8 is a perspective view of the second embodiment of the invention; and, FIG. 9 is an enlarged longitudinal section view, cut away in part, of a third embodiment of the invention.

In FIGS. 7 and 8, there is shown another embodiment of the invention, that is, a double seat (A') to be used for two persons. It is composed of two right and left sub-seats ($A_1'$) ($A_1'$), each of which is formed in a similar way to the above-mentioned first embodiment. A cut groove (12') is formed in the upper portion of the seat (A') between the two cushion members (a')(a') which respectively constitute the right and left sub-seats ($A_1'$)($A_1'$). A through-bore (13') for insertion of the hanger member is formed in the bottom portion of the cut groove (12'). In a similar manner to the first embodiment, a partition cloth (1') and the hanger members are inserted and secured so as to hang in or pull in the portion of the top member between the sub-seats ($A_1'$) and ($A_1'$). Therefore, even when any load is applied to one of the sub-seats ($A_1'$), the other sub-seat will not be influenced or deflected by such load. It should be noted that each of the cushion member (a')(a') comprises a lamination of two upper and lower foam members.

Figure 9:
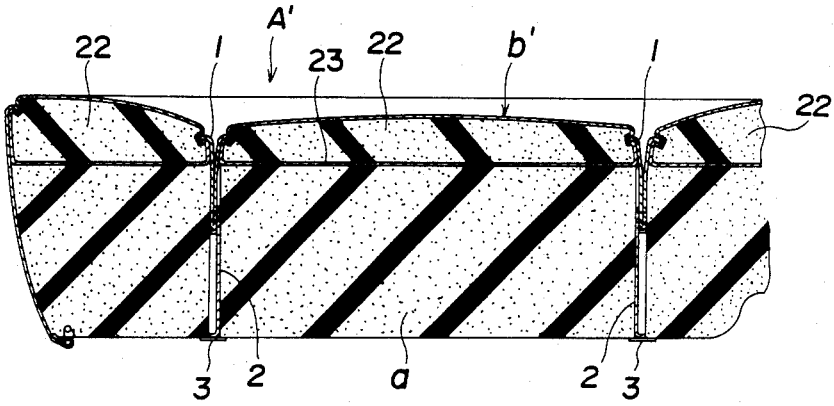

FIG. 9 illustrates another embodiment of the invention in which a top member (b') includes a thicker wadding (22) formed of a foam member, such thick wadding (22) is placed on a cushion member (a), and hang-in members (2) are pulled in by means of its associated partition cloths (1). In this figure, reference character (23) designates a wadding cover. This means that, according to the invention, it is possible to place and fix a foam member onto the cushion member (a), if desired.

Since the seat of the invention is constructed in the above-mentioned manner, when a load is applied to the central portion of the seat, the central portion is flexed to a suitable degree, but the peripheral or side portions thereof will not be affected by such flexing of the central portion.

Accordingly, since the seat of the invention is not deformed in its outer peripheral portions such as its side portions during use of the seat, the peripheral portions of the cushion member of the invention can maintain its shape during long periods of use and thus any wrinkles are not produced. Also, since the side frame portions of the top member is prevented from rising up when an occupant is seated on the seat as in the conventional seats, a sitting touch can be improved over the conventional ones.

What is claimed is:

1. A vehicle seat including a cushion member formed of a foam material with a plurality of grooves being cut therein so as to divide the cushion member into a central portion and side portions and forming boundary lines between the separate central portion and side portions, comprising:

a top member covering said cushion member, said top member including a top member central portion and a separately formed top member side portions, both of which are configured to correspond to and cover the respective central and side portions of said cushion member;

a plurality of partition cloths each of which is folded into U-shaped configuration so as to form a longitudinally-extending closed end and a longitudinally-extending open end containing the two free edges, each of said partition cloths having its closed end extending into said respective grooves in said cushion member, one of said two free edges of each said partition cloth being affixed to said top member central portion and the other of said two free edges of each said partition cloth being affixed to said top member side portions;

a plurality of hanger members with one end of each hanger member being affixed to said partition cloths;

means for anchoring the other end of each said hanger member to the underside of said cushion member so as to draw said partition cloths and said top member portions attached thereto into close fitting contact with said respective cushion member portions and into said grooves; and said means for anchoring each of said hanger members to the underside of said cushion member includes a plurality of bores in said cushion member spaced at predetermined intervals corresponding to the location of said respective hanger members so that each said hanger member is extendable through a respective bore, each said bore extending from said grooves to the underside of said cushion member and a securing plate affixed to each of said hanger members, said securing plate being adapted to secure said other end of each said hanger member to the underside of said cushion member.

* * * * *